US005400041A

United States Patent [19]

Strickland

[11] Patent Number: 5,400,041

[45] Date of Patent: Mar. 21, 1995

[54] RADIATING ELEMENT INCORPORATING IMPEDANCE TRANSFORMATION CAPABILITIES

[76] Inventor: Peter C. Strickland, 114 Oriole Avenue, Kanata, Ontario K2L 1E7, Canada

[21] Appl. No.: 116,811

[22] Filed: Sep. 7, 1993

Related U.S. Application Data

[63] Continuation of Ser. No. 736,641, Jul. 26, 1991, abandoned.

[51] Int. Cl.[6] ..... H01Q 1/38

[52] U.S. Cl. ..... 343/700 MS; 343/846

[58] Field of Search ..... 343/700 MS, 767, 770, 343/771, 829, 846, 769; H01Q 1/38; 26/100

[56] References Cited

U.S. PATENT DOCUMENTS

| | | | |
|---|---|---|---|
| 3,995,277 | 11/1976 | Olyphant, Jr. | 343/846 |
| 4,138,684 | 2/1979 | Kerr | 343/700 MS |
| 4,191,959 | 3/1980 | Kerr | 343/700 MS |
| 4,318,107 | 3/1982 | Pierrot et al. | 343/700 MS |
| 4,613,868 | 9/1986 | Weiss | 343/700 MS |
| 4,630,064 | 12/1986 | Andrews et al. | 343/895 |
| 4,692,769 | 9/1987 | Gegan | 343/770 |
| 4,766,440 | 8/1988 | Gegan | 343/767 |
| 4,771,291 | 9/1988 | Lo et al. | 343/700 MS |
| 4,873,529 | 10/1989 | Gibson | 343/700 MS |
| 4,987,421 | 1/1991 | Sunahara et al. | 343/769 |
| 5,231,406 | 7/1993 | Sreenivas | 343/700 MS |

FOREIGN PATENT DOCUMENTS

| | | | |
|---|---|---|---|
| 385863 | 12/1939 | Canada . | |
| 1119289 | 3/1982 | Canada . | |
| 1097428 | 3/1989 | Canada . | |
| 1263745 | 12/1989 | Canada . | |
| 2014629 | 4/1990 | Canada . | |
| 0004206 | 11/1986 | Japan | 343/700 MS |

*Primary Examiner*—Donald Hajec
*Assistant Examiner*—Tan Ho
*Attorney, Agent, or Firm*—Vorys, Sater, Seymour and Pease

[57] ABSTRACT

This invention relates to a radiating element, such as a microstrip antenna, having a low input impedance and being capable of allowing high RF power to be supplied to the radiating element. The radiating element incorporates impedance transformation capabilities by providing a dielectric member with an electrically conductive ground plane formed on one side of the dielectric member. A metal patch element is formed on the other side of the dielectric member and spaced from the ground plane by the dielectric member. The patch element is capable of radiating RF energy when coupled to a source of RF input energy applied thereto. An impedance transforming section is selectively located within the perimeter of the patch element to give a desired input impedance at a feedpoint of the impedance transformation section.

24 Claims, 8 Drawing Sheets

CONVENTIONAL RADIATING ELEMENT IMPEDANCE

RADIATING ELEMENT WITH IMPEDANCE TRANSFORMING CAPABILITY

RADIATING ELEMENT INCORPORATING IMPEDANCE TRANSFORMATION CAPABILITIES

This is a continuation of application Ser. No. 07/736,641, filed on Jul. 26, 1991, now abandoned.

FIELD OF THE INVENTION

This invention relates to antennas incorporating impedance transformation capabilities, and particularly microstrip patch antennas having impedance transformation capabilities.

BACKGROUND OF THE INVENTION

The use of microstrip in the field of microwave circuit design is fairly well known and understood in the art. Microstrip consists of a single dielectric substrate with a conductive ground plane on one face of the substrate and a metallized layer on the other face. A microstrip antenna is typically a rectangular patch of metal etched on the metallized coating side. A signal is applied to the antenna via a connector at a feed point on the antenna, normally at one edge of the patch.

As is also well known in the art, when two sections or components of different impedances are connected together, an impedance transformer is invariably required to ensure maximum power transfer from one section to another. In the case of a microwave antenna, it is necessary to match the input impedance of the antenna to that of the antenna feed line, in order to maximize power transfer from the feed line to the antenna. This matching is normally performed by a section of metal extending from the antenna patch and the end of which is connected to the feed connector. A typical matching system is shown in Canadian patent 1,097,428, having a thin line of metal, which for this specific example has a width of 0.2 inches and a length of about 1½ inches.

Conventional edge-fed microstrip patches have a very high input impedance. The input impedance (z) of a line in microstrip is approximately proportional to the width (W) of the line and inversely proportional to the thickness or height (h) of the substrate (z approximately proportional to (W/h)). It may be seen then that for a very narrow substrate, that is a small value of h, the width of the line would have to be also very small in order to transform to a useable input impedance, i.e. an impedance lower than that of a patch antenna. This situation is adequate as long as the RF power into the line is relatively small. However, in high power applications the width of the line becomes a limitation and would tend to burn up.

A further problem in matching Occurs when a relatively thick substrate is used. In this situation, as is well known in the art, the impedance matching section would have to be relatively wide. This relatively wide section affects the radiation pattern of the patch element. Consequently, it is necessary to use a thin substrate on a separate layer in order to transform the impedance. However this transformation to a thin substrate results in a narrow matching section, which once again is limited in its power handling. a further problem is that this section is placed out of the plane of the patch element. Various ways of achieving this are well known in the art. In modern applications of antennas, such as in cellular base stations and the like, space is extremely limited. Therefore, placing a matching section out of the plane of the antenna is not desirable.

It is an object of this invention to provide a radiating element that has a low input impedance and eliminates the need for a narrow matching transformer, and thus allowing higher RF power to be supplied to the antenna, and without interfering substantially with the radiation pattern of the antenna, while also achieving a relatively easy to manufacture and compact design.

SUMMARY OF THE INVENTION

This invention seeks to provide a radiating element having a low input impedance and being capable of allowing high RF power to be supplied to the radiating element.

In accordance with the present invention there is provided a radiating element incorporating impedance transformation capabilities comprising a dielectric member;

an electrically conductive ground plane formed on one side of the dielectric member;

a metal patch element formed on the other side of the dielectric member and spaced from the Found plane by the dielectric member, the patch element for radiating RF energy when coupled to a source of RF input energy applied to the patch; and means for transforming the impedance of the patch element to give a desired impedance at a feedpoint of the transformation means, the means selectively located within the perimeter of the patch element.

BRIEF DESCRIPTION OF THE DRAWINGS

A better understanding of the invention will be obtained by reference to the detailed description below in connection with the following drawings in which:

FIG. 4 is a Smith chart plot of the input impedance of a microstrip antenna according to the prior an;

DETAILED DESCRIPTION OF THE PREFERRED EMBODIMENT

Figure 1:
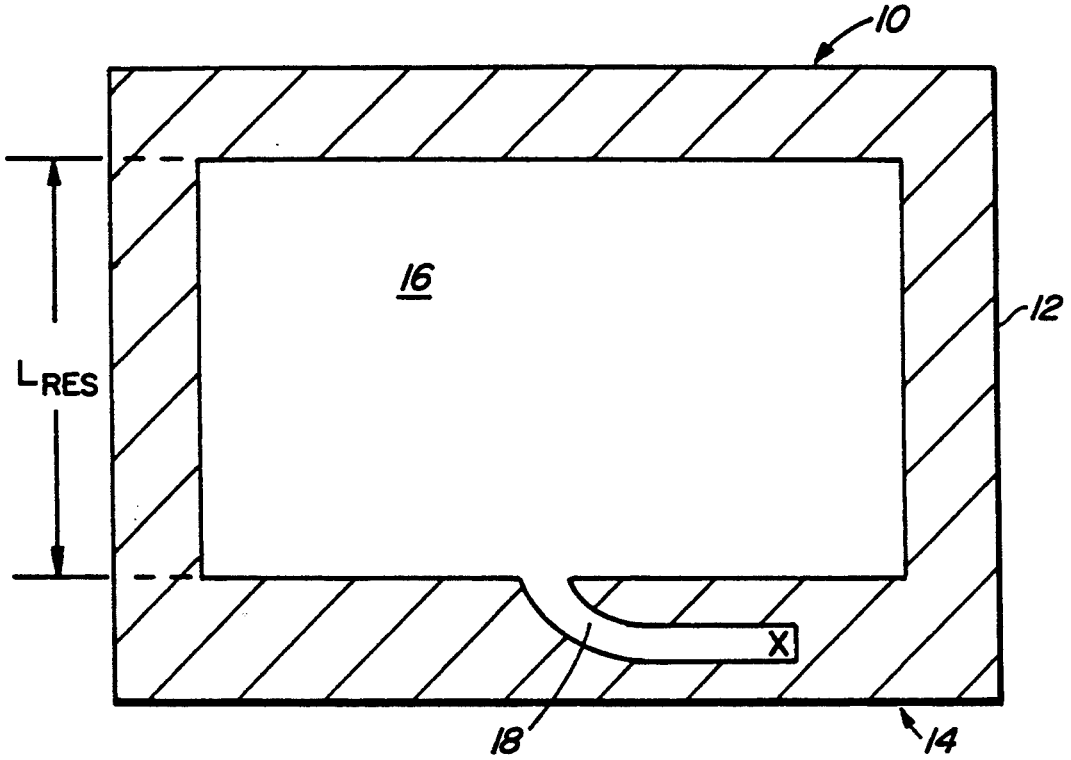
(PRIOR ART) FIG. 1
FIG. 1 is a top view of a microstrip patch antenna having input matching capabilities according to the prior art.

Referring to FIG. 1, a microstrip patch antenna according to the prior art is indicated generally by numeral 10. The antenna 10 comprises a dielectric member or substrate 12. One side of the substrate 12 is clad entirely by a layer of metallic material to form a ground plane 14. The other side of the substrate is also clad in a metallic layer, however, pan of the layer is etched away to form a patch 16, being roughly rectangular in shape. As mentioned earlier an impedance transformer is required to match the impedance of the antenna 16 to that of the feedline. A metallic strip 18 extends from one edge of the patch 16. The metallic strip 18 acts as an impedance matching means or impedance transformation network for the patch radiating element 16. A signal input feed (not shown) is connected at the point marked X at one end of the impedance transformer strip 18. As is also well known in the art, the dimension $L_{RES}$ of a microstrip patch element is determined by the radiating frequency of the antenna. This is nominally chosen to be approximately half the wavelength of the desired centre frequency of the antenna. The dimensions for the matching transformer are also determined by various other factors, which are themselves interrelated. Hence, the determination of the exact dimensions to achieve optimum radiation at the frequency of interest usually requires several iterations. The strip in this case has dimensions of approximately 0.89 inches in length and 0.2 inches in width.

Figure 4:
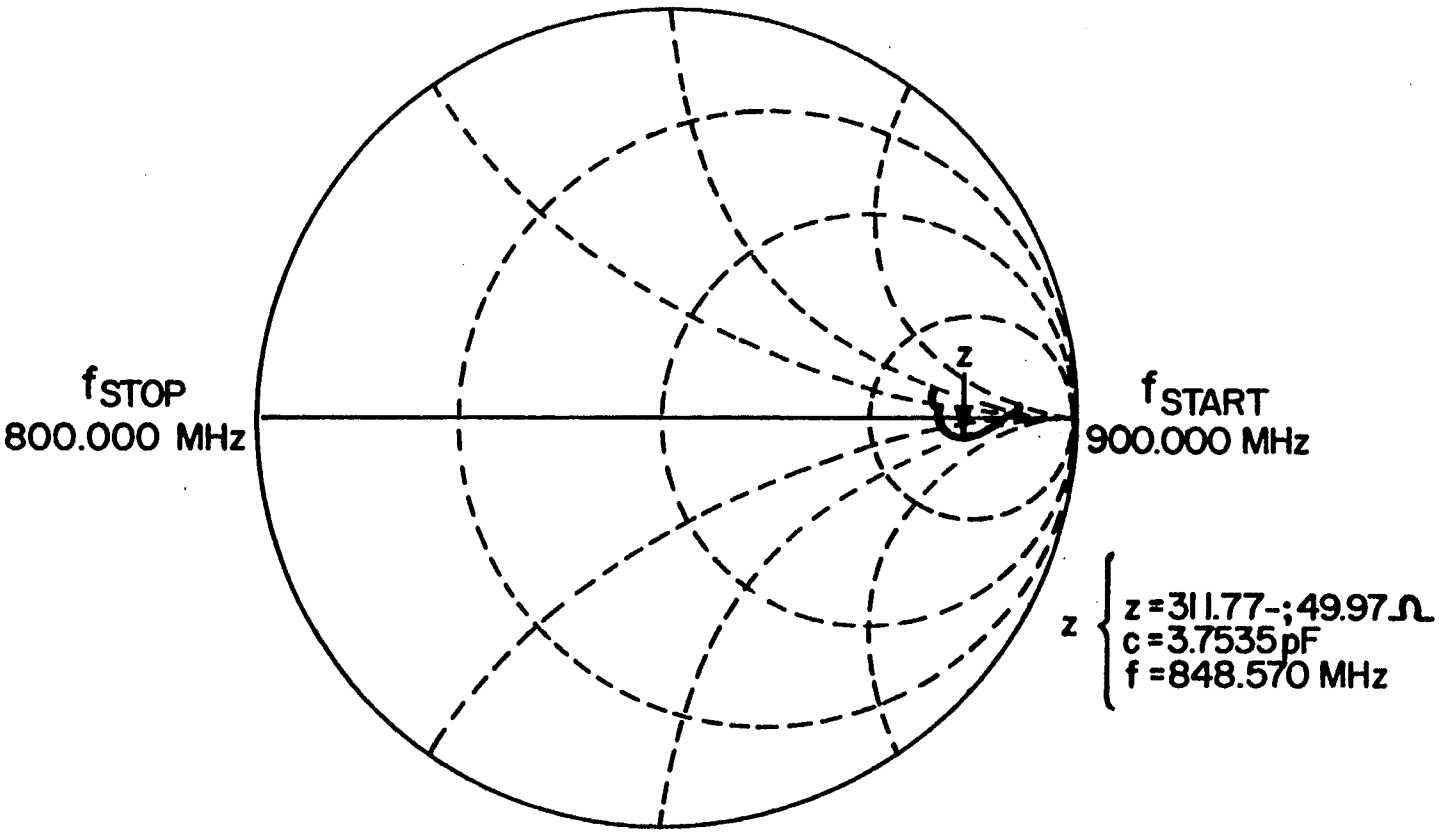

The input impedance of a conventional prior an antenna, having a similar matching transformer 18 to that of FIG. 1, is shown by the Smith chart plot of FIG. 4. The plot is shown from a frequency of 800 megahertz to 900 megahertz, which covers the assigned frequency range for cellular telephone operation in North America.

Figure 2:
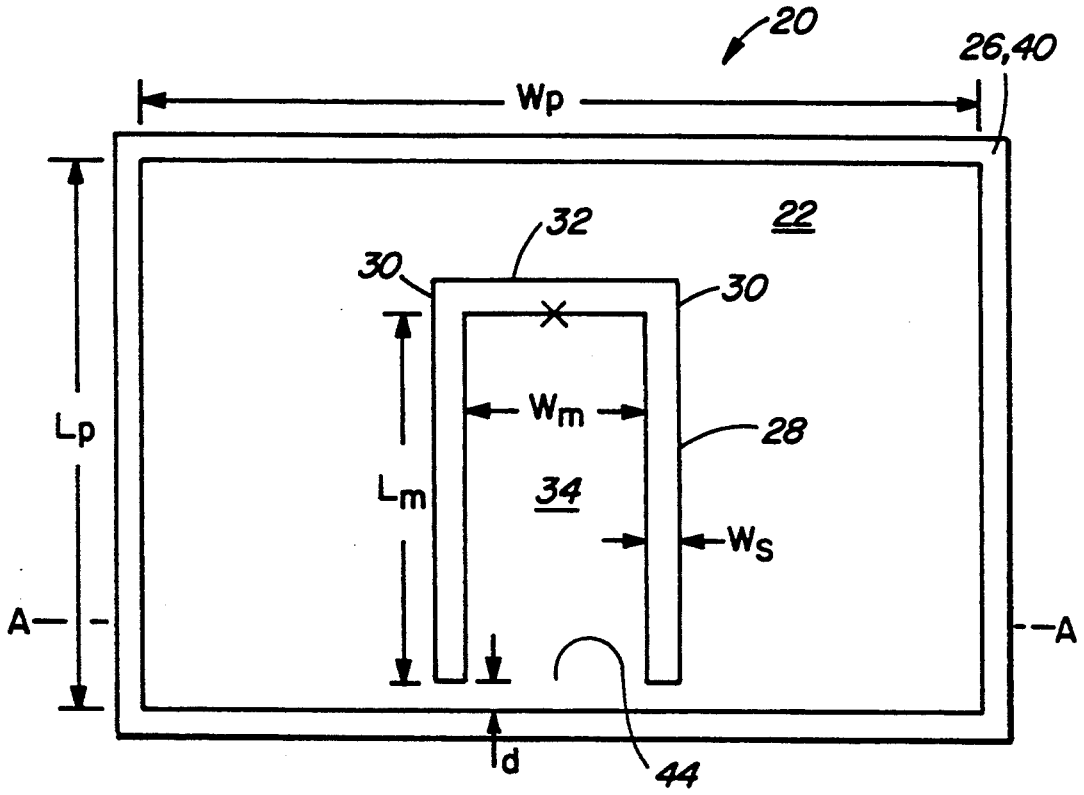
FIG. 2 is a top view of a microstrip patch antenna having matching capabilities according to the present invention.
Figure 3:
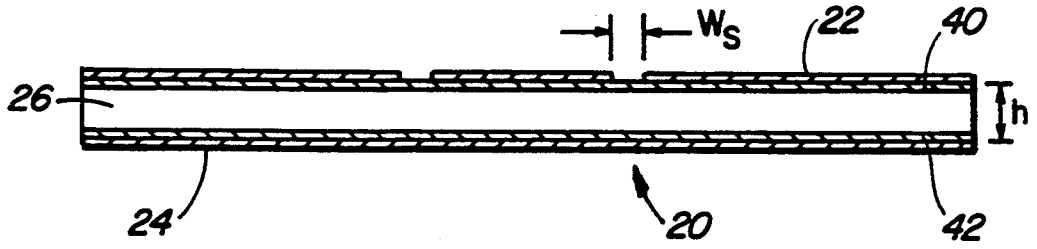
FIG. 3 is a cross-sectional view along the line A—A' shown in FIG. 2.

Referring to FIGS. 2 and 3, a microstrip antenna according to the present invention is shown generally by numeral 20. The antenna 20 has a radiating metal patch element 22 positioned above a conducting ground plane 24. A dielectric member or substrate 26 separates the ground plane 24 from the patch 22. Referring specifically to FIGS. 2 and 3, a U-shaped slot is formed within the perimeter of the patch 22. The slot 28 is typically formed in the patch 22 by etching the patch metal to reveal the substrate 26. Any other convenient method may also be used. On the antenna as constructed, the metal for each of the layers 22 and 24 is copper with a thickness of 1.0 oz/square foot. The slot defines, within its outline, a matching transformer 34 having width ($W_m$) and a length ($L_m$).

As mentioned earlier the dimensions for a matching transformer as in the prior art are determined not only by the frequency of interest but also various other factors which are interrelated. Similarly, for the matching transformer of the present invention the dimensions of the matching transformer element are chosen by firstly deciding on the bandwidth of operation for the antenna and then choosing a suitable quarter wavelength transformer to provide the requisite impedance match. The length of the transformer $L_m$ is chosen to be approximately one quarter of the wavelength of interest for the antenna. The width $W_m$ is such that the transformer impedance in the presence of coupling to the patch structure is that required to give the desired input impedance at the feed point marked X near the end of the transformer 34.

Having chosen the desired transformer dimensions various techniques may be used to fine tune the dimensions to achieve the desired input impedance at the feed point X. An optimization packages such as FMPS TM may additionally be used to optimize the dimensions.

In the embodiment of FIG. 3 an air dielectric substrate antenna is shown. The height (h) of the dielectric substrate 26 is approximately ½ inch thick. The substrate is comprised of a layer 26 of paper honeycomb impregnated with phenolic resin. The fiberglass layers 40 and 42 are attached to opposite surfaces of the paper honeycomb layer 26, respectively. The fiberglass layers are each 0.010 inches thick. The following are the dimensions of the antenna which were determined by employing the techniques mentioned above for an antenna operating in the 800 MHz to 900 MHz frequency band:

patch width (Wp)—220 millimetres
patch length ($L_p$)—126.7 millimetres
transformer width ($W_m$)—21.2 millimetres
transformer length ($L_m$)—90 millimetres
slot width ($W_s$)—5 millimetres
distance of slot from edge of patch (d)—2.5 millimetres.

With the dimensions of the transformer 34 as above, the impedance looking into the patch at the end of the transformer 34 is approximately 235 ohms. The impedance 44 looking into the matching transformer at its feed point X is approximately 87.5 ohms at 860 MHz. The characteristic impedance of the matching section 34 in the presence of coupling across the slot 28 is approximately 143.4 ohms.

Figure 5:
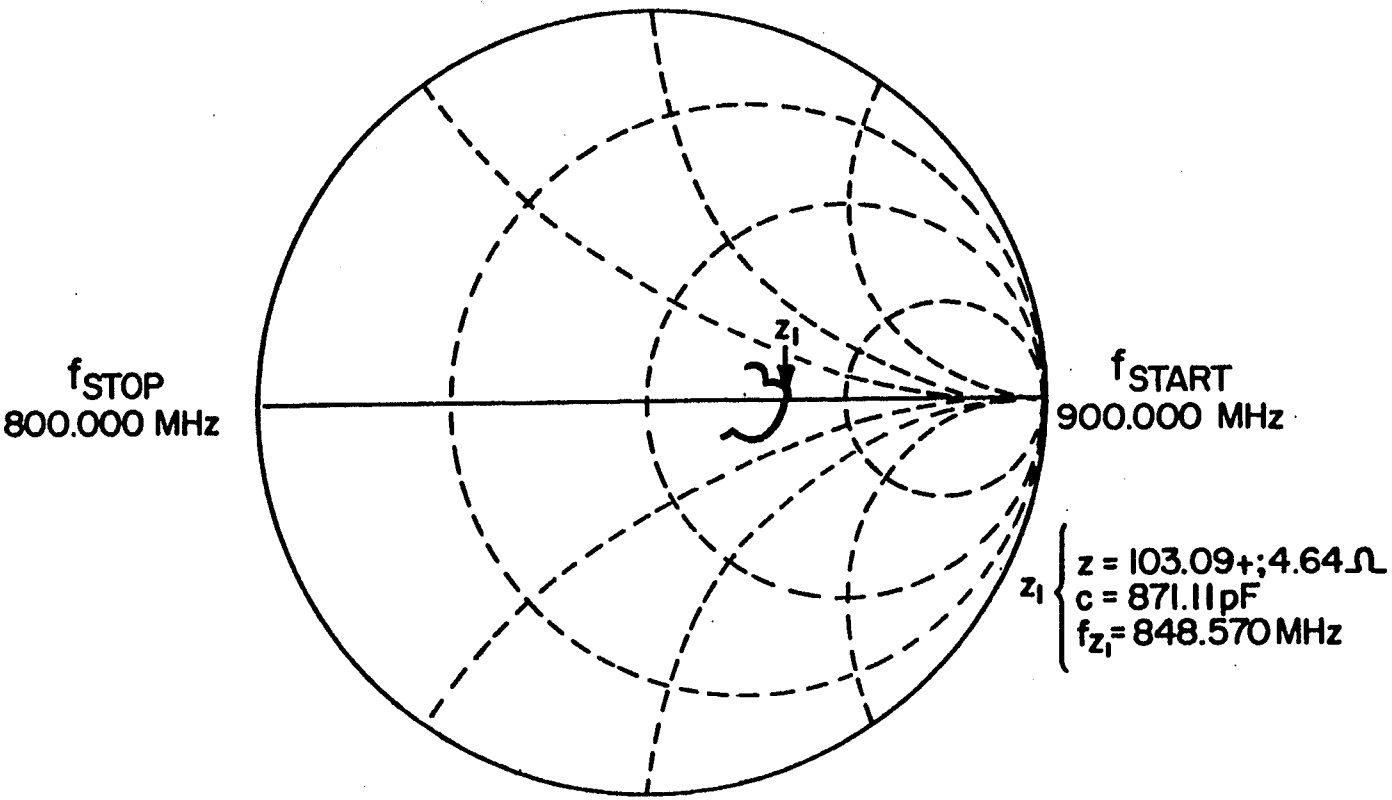
FIG. 5 is a Smith chart plot of the input impedance of a microstrip antenna according to the present invention.

Referring to FIG. 5, the plot of the input impedance of the radiating element in FIG. 3 is shown plotted on a Smith chart. The plot is shown over the frequency range of 800 to 900 megahertz. It may be seen that the transformer provides a match to 87.5 ohms at point Z, on the chart which corresponds to a frequency of 848.57 MHz. For the antenna dimensions shown above, a power of 200 W was fed into the antenna without damage to the matching transformer.

Figure 6:
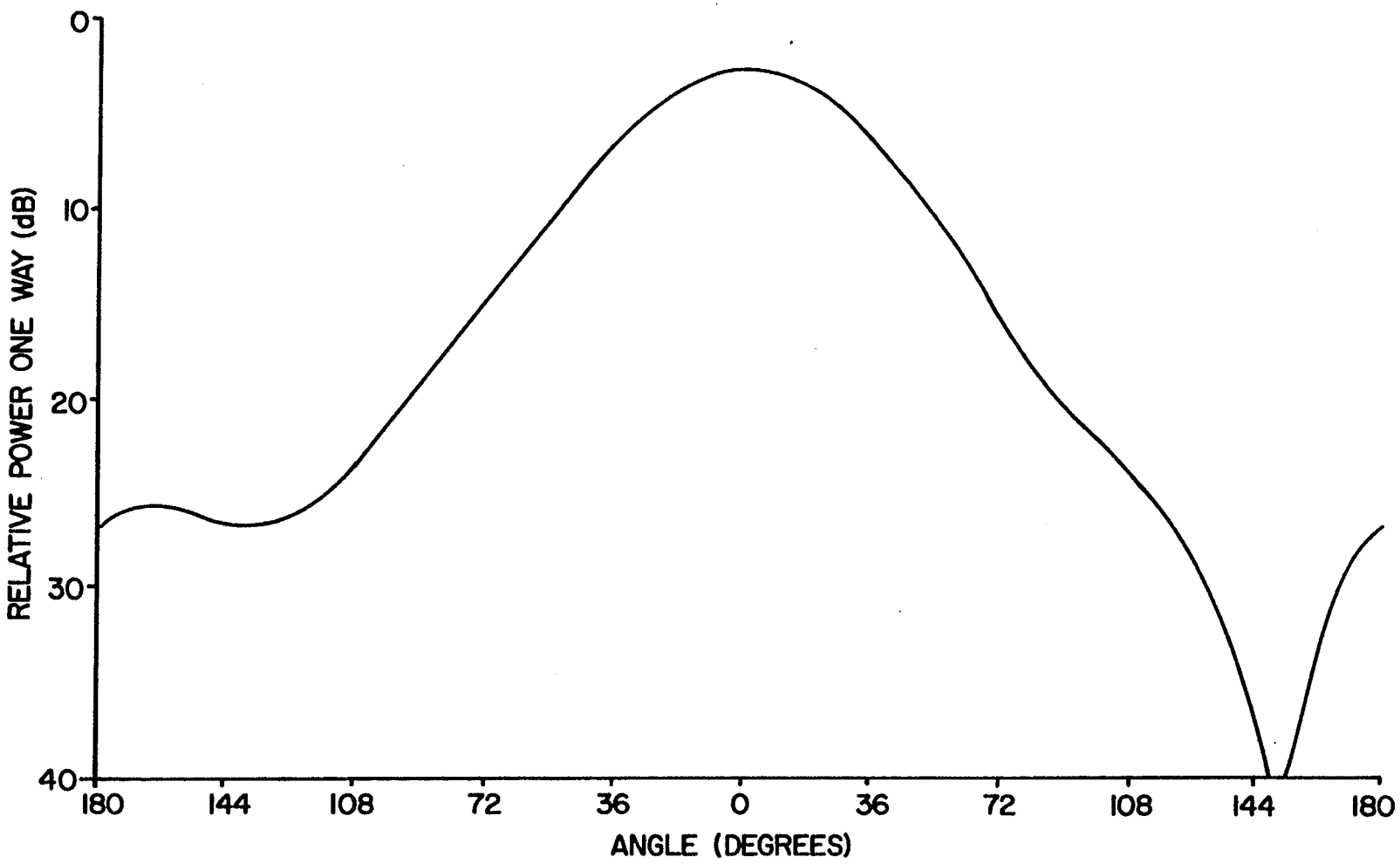
FIG. 6 is a plot of the radiation pattern of an antenna along its azimuth according to the present invention.
Figure 7:
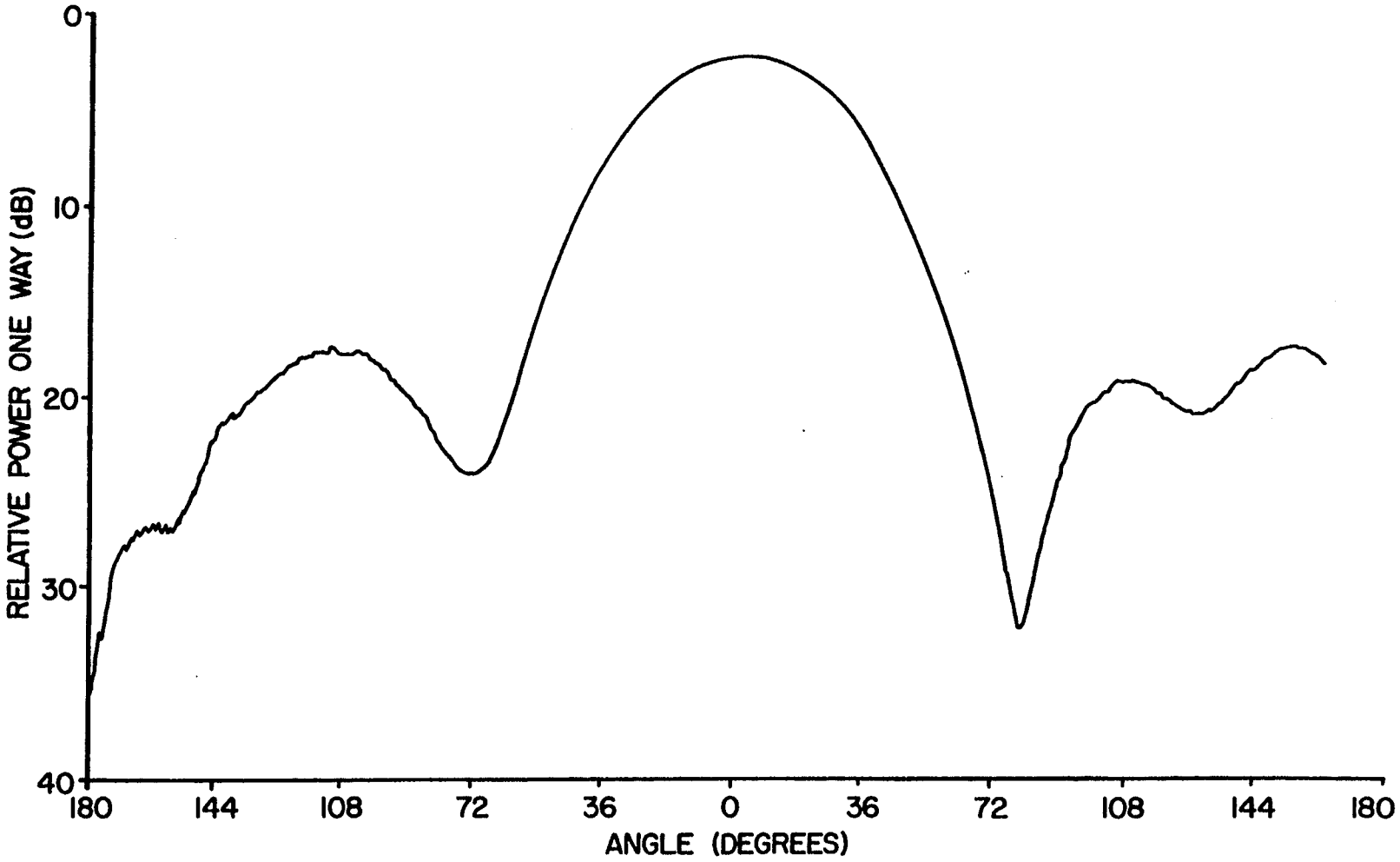
FIG. 7 is a plot of the radiation pattern of an antenna along its elevation according to the present invention.
Figure 8:
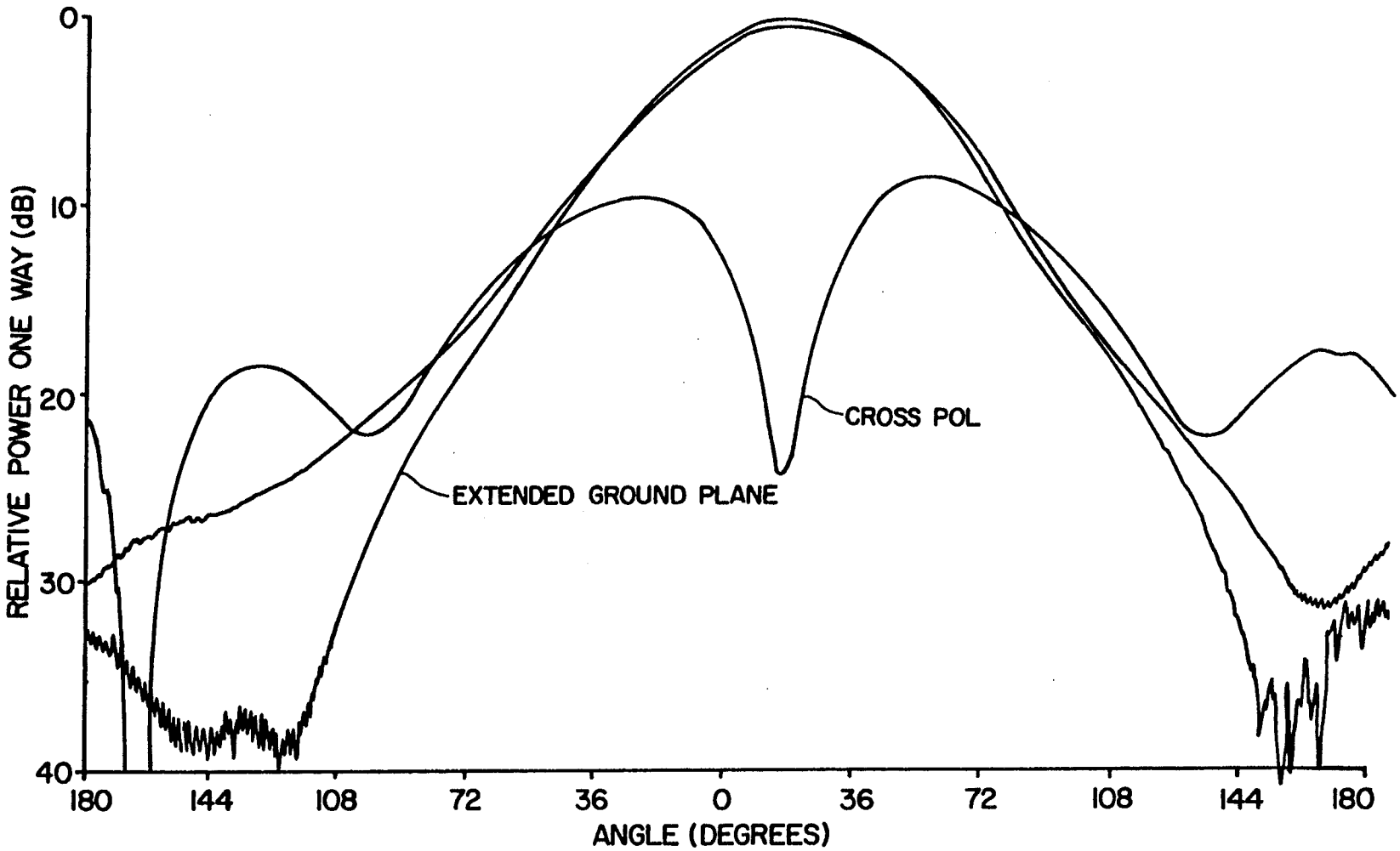
FIG. 8 is a plot of the azimuth gain characteristics of an antenna according to the present invention.

Referring to FIGS. 6 and 7, the azimuth and elevation pattern of the antenna of FIG. 3 is shown. It may be seen that there is a single well defined lobe along the axis of the antenna with the 3-dB points of the lobe being at approximately thirty degrees at either side in the azimuth plane. It may also be seen from FIGS. 6 and 7 that the side lobe levels are extremely low for the antenna in FIG. 3.

Figure 9:
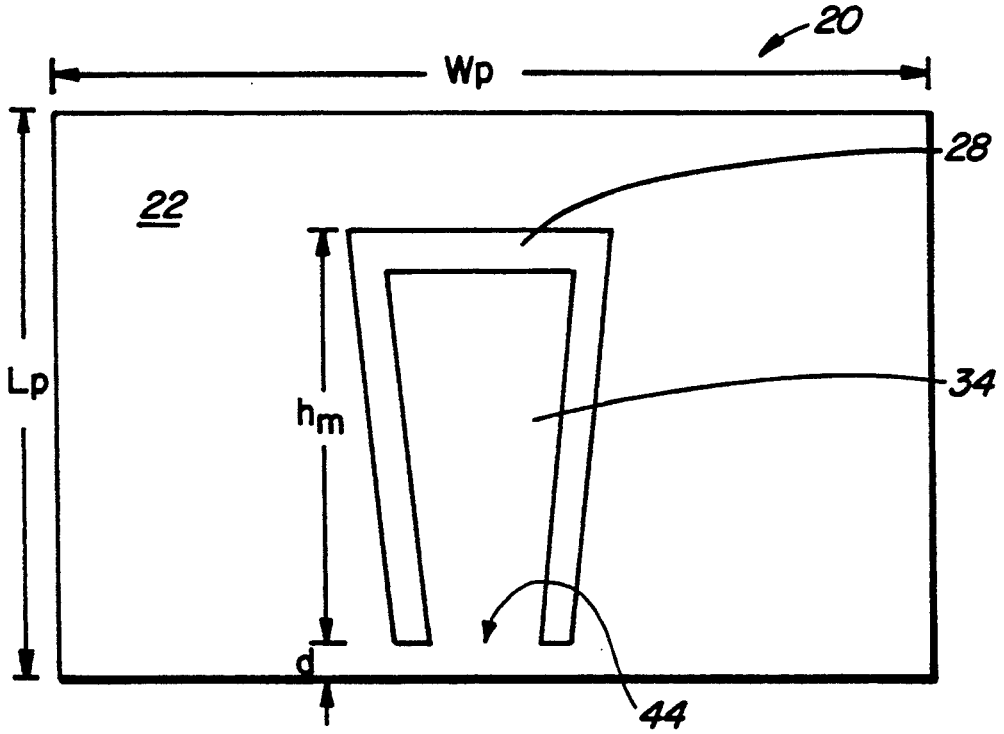
FIG. 9 illustrates the antenna of the present invention having an impedance matching transformer with a tapered width.
Figure 10:
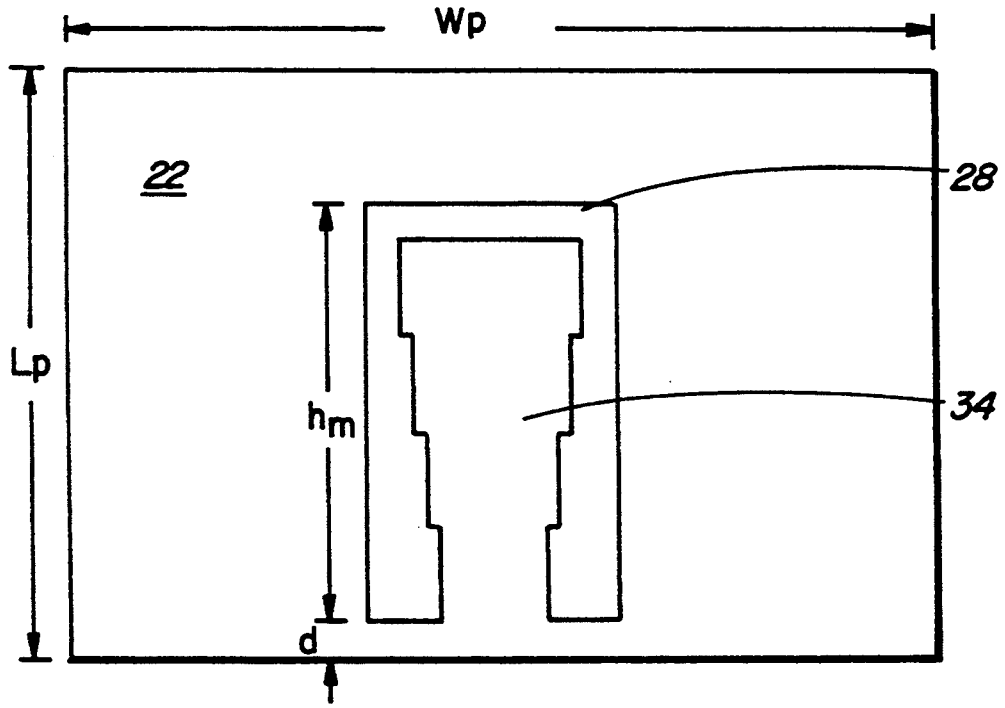
FIG. 10 shows the antenna of the invention with an impedance matching transformer comprising a plurality of stepped width sections.

The matching transformer in FIG. 3 has been described with reference to a rectangular section, however, other sections may also be used to achieve the requisite matching. A tapered section having its wide end at the feed point and the tapered end at connection with the patch may also be used. Various forms of stepped section elements may also be used where each section provides its own impedance characteristics. These transformer sections are well known in the art. FIG. 9 illustrates an embodiment of the antenna with an impedance matching transformer having a tapered width, while FIG. 10 shows an embodiment of the antenna wherein the transformer has a plurality of stepped width sections. It must also be noted that coupling occurs across the slot which in conjunction with the impedance of the patch provides the impedance transformation required to get the desired input impedance at the feed point near the end of the transformer.

While the invention has been described in connection with a specific embodiment thereof and in a specific use, various modifications thereof will occur to those skilled in the an without departing from the spirit and scope of the invention as set forth in the appended claims, such as using the antenna for receipt of radiated RF energy.

The terms and expressions which have been employed in the specification are used as terms of description and not of limitations, and there is no intention in the use of such terms and expressions to exclude any equivalents of the features shown and described or portions thereof, but it is recognized that various modifications are possible within the scope of the claims to the invention.

The embodiments of the invention in which an exclusive property or privilege is claimed are defined as follows:

1. An antenna comprising:

an electrically conductive ground plane formed on one side of said dielectric member;

a metal patch element formed on the other side of said dielectric member and spaced from said ground plane by said dielectric member, said patch element for radiating RF energy at a single predetermined frequency when coupled to a source of RF input energy applied to said patch; and means for transforming the impedance of said patch element to a predetermined impedance at a feed point located on said transforming means, said transforming means being electrically connected at one end thereof to said patch element and selectively located entirely within the perimeter of said patch element and being entirely surrounded by said patch element, said feed point location being at an end remote from said one end and separated by an effective electrical length of an odd number of quarter wavelengths at said predetermined frequency;

said transformation means being a section of metal electrically connected at one end to said patch element and isolated in part at its feedpoint from said patch element by a slot, said slot characterized by an absence of metal;

said slot being a U-shaped slot.

2. An antenna comprising:

a dielectric member;

an electrically conductive ground plane formed on one side of said dielectric member;

a metal patch element formed on the other side of said dielectric member and spaced from said ground plane by said dielectric member, said patch element for radiating RF energy at a single predetermined frequency when coupled to a source of RF input energy applied to said patch;

means for transforming the impedance of said patch element to a predetermined impedance at a feedpoint of said transforming means, said means for transforming being selectively located entirely within the perimeter of said patch element and being entirely surrounded thereby; and said means for transforming being a quarter wavelength section of metal electrically connected at one end thereof to said patch element and isolated in part at an end remote to said one end from said patch element by a slot, said feedpoint located at said remote end and said slot characterized by an absence of metal, said slot being a U-shaped slot.

3. An antenna as defined in claim 2, said radiating patch element being a planar rectangular patch.

4. An antenna as defined in claim 3, said U-shaped slot being arranged with its axis of symmetry on an axis of symmetry of said patch element.

5. An antenna as defined in claim 2, said section having a resonant length aligned parallel to a resonant length of said patch element.

6. An antenna as defined in claim 2, said section having a tapered width.

7. An antenna as defined in claim 2, said section having a plurality of stepped width sections.

8. An antenna as defined in claim 2, said ground plane being made of copper and having a thickness of 1.0 oz. per square foot.

9. An antenna as defined in claim 8, said metal patch element being made of copper and having a thickness of 1.0 oz. per square foot.

10. An antenna as defined in claim 9 said dielectric member being a low dielectric constant material.

11. An antenna as defined in claim 10, said low dielectric constant material being a paper honeycomb impregnated with phenolic resin.

12. An antenna as defined in claim 11, said dielectric having a thickness of approximately ½ inch.

13. An antenna as defined in claim 11, said dielectric member further comprising two fiberglass layers attached to opposite surfaces of said honeycomb layer.

14. An antenna comprising:

a dielectric member;

an electrically conductive ground plane formed on one side of said dielectric member;

a metal patch element formed on the other side of said dielectric member and spaced from said ground plane by said dielectric member, said patch element for radiating RF energy at a single predetermined frequency when coupled to a source of RF input energy applied to said patch;

means for transforming the impedance of said patch element to give a desired impedance at a feedpoint of said transforming means, said transforming means selectively located within the perimeter of said patch element and entirely surrounded thereby;

said means for transforming being a section of metal electrically connected at one end to said patch element and isolated in part at its feedpoint from said patch element by a U-shaped slot, said slot characterized by an absence of metal;

said radiating patch element being a planar rectangular patch;

said dielectric member being a thick dielectric and having a low dielectric constant;

said U-shaped slot being arranged with its axis of symmetry on an axis of symmetry of said patch element, such that the resonant length of said section is aligned parallel to the resonant length of said patch element; and said section defined by said U-shaped slot, being a quarter wavelength section.

15. A single frequency microstrip patch antenna with impedance matching capabilities comprising:

a planar dielectric member;

a metal patch element formed on a face of said dielectric member, said patch comprising a generally U-shaped nonconductive slot dividing said patch into a radiating element and a impedance matching transformer, said slot partially surrounding said transformer, said transformer and said radiating element being in electrical contact along the open side of said U-shaped slot;

a feedpoint on said transformer situated at an edge opposite to the open side of said U-shaped slot; and an electrically conductive ground plane formed on the opposite face of said dielectric member.

16. An antenna as defined in claim 15, said patch element being a planar rectangular patch.

17. An antenna as defined in claim 16, said transformer having a length aligned parallel to the length of said patch element.

18. An antenna as defined in claim 17, said dielectric member being a thick dielectric.

19. An antenna as defined in claim 17, the length of said transformer being a quarter wavelength.

20. An antenna as defined in claim 15, said transformer having a tapered width.

21. An antenna as defined in claim 15, said transformer having plurality of stepped width sections.

22. An antenna as defined in claim 15, wherein the length of said radiating element and the length of said transformer are approximately a half and respectively a quarter of the wavelength at said single frequency.

23. A method of producing a single frequency microstrip patch antenna with impedance matching capabilities comprising the steps of:

providing a planar dielectric member;

covering said dielectric member on opposite sides with a conductive material to form a ground plane and a patch element;

removing the conductive material of said patch element to form a U-shaped slot which divides said patch element into a radiating element and an impedance matching transformer, said slot partially surrounding said transformer, said transformer and said radiating element being in electrical contact along the open side of said U-shaped slot; and providing a feedpoint on said transformer situated at an edge opposite to said open side.

24. A method as claimed in claim 23, comprising the step of selecting the width of said transformer for obtaining an input impedance of said antenna at said feedpoint matching the impedance of an external energizing means.

* * * * *